US008378961B2

(12) United States Patent
Sangam et al.

(10) Patent No.: US 8,378,961 B2
(45) Date of Patent: Feb. 19, 2013

(54) CONTROL OF LIGHT-EMITTING-DIODE BACKLIGHT ILLUMINATION THROUGH FRAME INSERTION

(75) Inventors: Dilip Sangam, Saratoga, CA (US); Balaji Venugopal Virajpet, San Jose, CA (US); Tushar Dhayagude, Santa Clara, CA (US)

(73) Assignee: Atmel Corporation, San Jose, CA (US)

( * ) Notice: Subject to any disclaimer, the term of this patent is extended or adjusted under 35 U.S.C. 154(b) by 497 days.

(21) Appl. No.: 12/688,742

(22) Filed: Jan. 15, 2010

(65) Prior Publication Data

US 2011/0175935 A1 Jul. 21, 2011

(51) Int. Cl.
*G09G 3/36* (2006.01)

(52) U.S. Cl. ..... 345/102; 345/82

(58) Field of Classification Search ..... 345/102, 345/82, 83, 76, 77, 87
See application file for complete search history.

(56) References Cited

U.S. PATENT DOCUMENTS

2005/0248554 A1 11/2005 Fen et al.

FOREIGN PATENT DOCUMENTS

| | | |
|---|---|---|
| EP | 1571644 | 9/2005 |
| EP | 1816637 | 8/2007 |
| EP | 1863008 | 12/2007 |

OTHER PUBLICATIONS

International Search Report and Written Opinion dated Apr. 29, 2011, 18 pages.

Invitation to pay additional fees for PCT/US2010/061028 dated Feb. 25, 2011, 7 pages.

International Preliminary Report on Patentability; Jul. 26, 2012; World Intellectual Property Organization (WIPO) (International Bureau of); PCTUS2010061028; 12 pages.

*Primary Examiner* — Ricardo L Osorio
(74) *Attorney, Agent, or Firm* — Fish & Richardson P.C.

(57) ABSTRACT

System(s) and method(s) are provided to regulate backlighting in a light emitting diode (LED)-based display through a sequence of alternate pulse-width-modulation (PWM) frame or sub-frame insertions. Alternate PWM frames or sub-frames can be black or non-black. A plurality of pixels in the display is partitioned into at least one zone including one or more rows of pixels; the at least one zone determines sub-frame period based on refresh frequency of the display. A sequence of alternate PWM sub-frames includes at least one alternate sub-frame and at least one normal sub-frame. Alternate PWM frames or alternate PWM sub-frames include a phase delay during which a backlight unit is turned off, and a PWM sequence in which the backlight unit is turned on with a finite duty cycle for the remainder of the PWM frame or sub-frame. A sequence of alternate PWM sub-frames can be configured internally or externally. Internal configuration can be synchronous with a reference signal whereas external configuration relies on external reference signal.

23 Claims, 12 Drawing Sheets

CONTROL OF LIGHT-EMITTING-DIODE BACKLIGHT ILLUMINATION THROUGH FRAME INSERTION

TECHNICAL FIELD

The subject disclosure relates to illumination systems that include light-emitting-diode (LED) technology and, more specifically, to regulation of backlight unit operation in a display based in part on insertion of black or non-black sub-frames or frames.

BACKGROUND

Backlights are used to illuminate liquid crystal displays ("LCDs"). LCDs with backlights are used in small displays for cell phones and personal digital assistants ("PDAs") as well as in large displays for computer monitors and televisions. Often, the light source for the backlight includes one or more cold cathode fluorescent lamps ("CCFLs"). The light source for the backlight can also be an incandescent light bulb, an electroluminescent panel ("ELP"), or one or more hot cathode fluorescent lamps ("HCFLs").

The display industry is enthusiastically pursuing the use of light emitting diodes (LEDs) as the light source in backlight display technology because CCFLs have many shortcomings: For instance, CCFLs do not easily ignite in cold temperatures, they require adequate idle time to ignite, and they require delicate handling. Moreover, LEDs generally have a higher ratio of light generated to power consumed than other backlight sources. Accordingly, displays with LED backlights can consume less power than other displays, which renders LED-based displays more sustainable. LED backlighting has traditionally been used in small, inexpensive LCD panels. However, LED backlighting is becoming more common in large displays such as those installed in computers and television sets. In large displays, multiple LEDs are required to provide adequate backlight for the LCD display.

In LCD displays, electrostatic response of a plurality of pixels to applied voltages associated with data provision can vary substantially within the display locus as a result of raster mechanism employed to configure the data in each of the plurality of pixels. In particular, conventional approaches to frame-to-frame update typically cease display, e.g., backlight unit is turned off for frames or sub-frames that are newly update and expected not to have settled a voltage associated with supplied data. Such black-out can cause image artifacts and can limit utilization of at least a portion of pixels in the plurality of pixels comprising the LCD display, with ensuing operation inefficiency thereof.

SUMMARY

The following presents a simplified summary of the subject disclosure in order to provide a basic understanding of some aspects thereof. This summary is not an extensive overview of the various embodiments of the subject disclosure. It is intended to neither identify key or critical elements nor delineate any scope. Its sole purpose is to present some concepts in a simplified form as a prelude to the more detailed description that is presented later.

One or more embodiments provide system(s) and method(s) to regulate backlighting in a light emitting diode (LED)-based liquid crystal display (LCD) through a sequence of alternate pulse-width-modulation (PWM) frames or sub-frames. Alternate frames can be black or non-black. Likewise, an alternate sub-frame can be black or non-black. A sequence of alternate PWM sub-frames includes at least one alternate sub-frame and at least one normal sub-frame. Likewise, a sequence of alternate PWM frames includes at least one alternate frame and at least one normal frame. A plurality of pixels in the LCD display is partitioned into at least one zone including one or more rows of pixels. The number of zones in a partition determines sub-frame period based on refresh frequency of the LCD display. Alternate PWM frames or alternate PWM sub-frames include a phase delay during which a backlight unit is turned off and a PWM sequence in which the backlight unit is turned on with a finite duty cycle for the remainder of the sub-frame. Normal PWM frames or sub-frames also include a phase delay that is smaller than the phase delay for an alternate PWM frame or sub-frame in a same insertion sequence. Backlight unit remains off during phase delay interval and is turned on according to a PWM sequence with finite duty cycle. A sequence of alternate PWM sub-frames can be configured internally or externally. Internal configuration exploits a multiplied instance of a reference clock signal, whereas external configuration relies on an external reference signal. Internal configuration leads to a periodic sequence of alternate PWM sub-frame insertions, whereas external configuration results in an asynchronous sequence of PWM sub-frame insertions.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

Figure 1A:
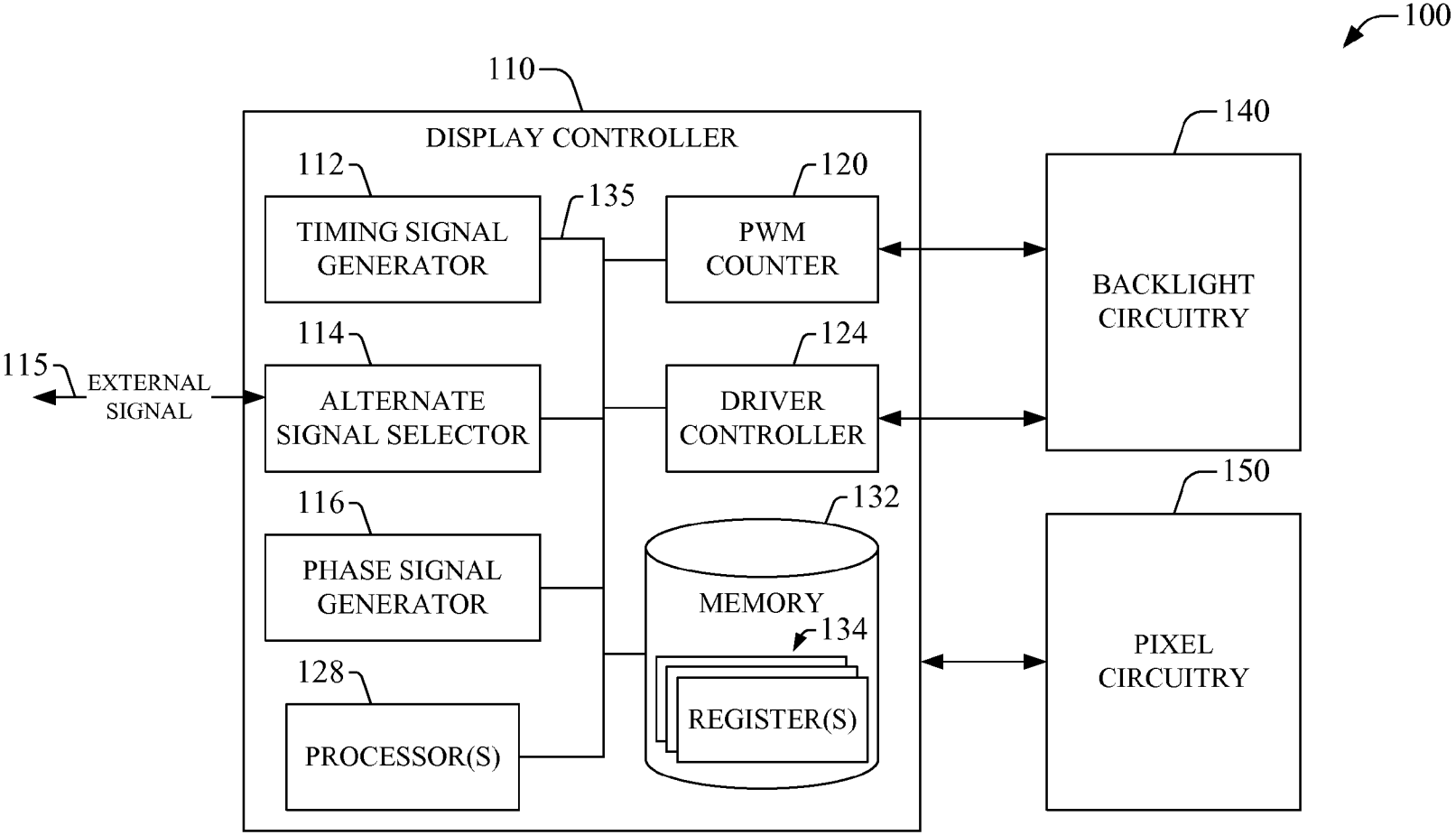
FIG. 1A is a functional block diagram of an example display that enables one or more aspects of the subject disclosure.

The subject disclosure is now described with reference to the drawings, wherein like reference numerals are used to refer to like elements throughout. In the following description, for purposes of explanation, numerous specific details are set forth in order to provide a thorough understanding of the present disclosure. It may be evident, however, that the various embodiments of the subject disclosure may be practiced without these specific details. In other instances, well-known structures and devices are shown in block diagram form in order to facilitate describing the present disclosure.

As employed in this specification and annexed drawings, the terms "component," "system," "interface," "controller," "multiplier" and the like are intended to include a computer-related entity or an entity related to an operational apparatus with one or more specific functionalities, wherein the entity can be either hardware, a combination of hardware and software, software, or software in execution. One or more of such entities are also referred to as "functional elements." As an example, a component may be, but is not limited to being a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. Also, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry which is operated by a software or a firmware application executed by a processor, wherein the processor can be internal or external to the apparatus and executes at least a part of the software or firmware application. As yet another example, a component can be an apparatus that provides specific functionality through electronic components without mechanical parts, the electronic components can include a processor therein to execute software or firmware that provides at least in part the functionality of the electronic components. As further yet another example, interface(s) can include input/output (I/O) components as well as associated processor, application, or Application Programming Interface (API) components. While the foregoing examples are directed to aspects of a component, the exemplified aspects or features also apply to a system, interface, multiplier and the like.

In addition, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Furthermore, the term "set" as employed herein excludes the empty set; e.g., the set with no elements therein. Thus, a "set" in the subject disclosure includes one or more elements or entities. As an illustration, a set of LED strings includes one or more LED strings; a set of frames in includes one or more frames; etc.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches also can be used.

FIG. 1A is a functional block diagram of an example display 100 that enables one or more aspects of the subject disclosure. Display controller component 110, also referred to herein and annexed drawings as display controller 110, regulates backlight circuitry 140 and pixel circuitry 150. Backlight circuitry 140 can include a set of strings of light emitting diodes (LEDs) distributed throughout the example display 100. Typically each string is coupled to a power supply on one end and to the ground on the other end. Preferably, one or more string of LEDs includes either red (R), blue (B), or green (G) LEDs. Each LED string that is part of backlight circuitry 140 can be selectively turned on and off for providing the various desired colors. A set of LED strings that can be part of backlight circuitry 140 includes one or more LED strings comprising a group of one or more LEDs which can be discretely scattered across an electronic display and connected in series by wires, traces or other connecting elements. LEDs in the set of LED strings can be arranged in vertical fashion or in other arrangements, such as horizontal configuration. Moreover, LED strings can be are mutually parallel or can be deployed in other relative orientations. One or more LED strings in a set of LED strings can be controlled by a driver circuit for application of voltage and supply of current. Pixel circuitry 150 comprises a plurality of pixels arranged in a matrix structure spanning K rows and J columns, with K and J positive integer numbers. Each row, or line, of pixels share a common gate voltage, while each column of pixels has a common data line. In an embodiment, each pixel includes a transistor (e.g., thin film transistor (TFT)), which is illuminated by at least one set of red, green, and blue LEDs, and at least one capacitor.

Figure 1B:
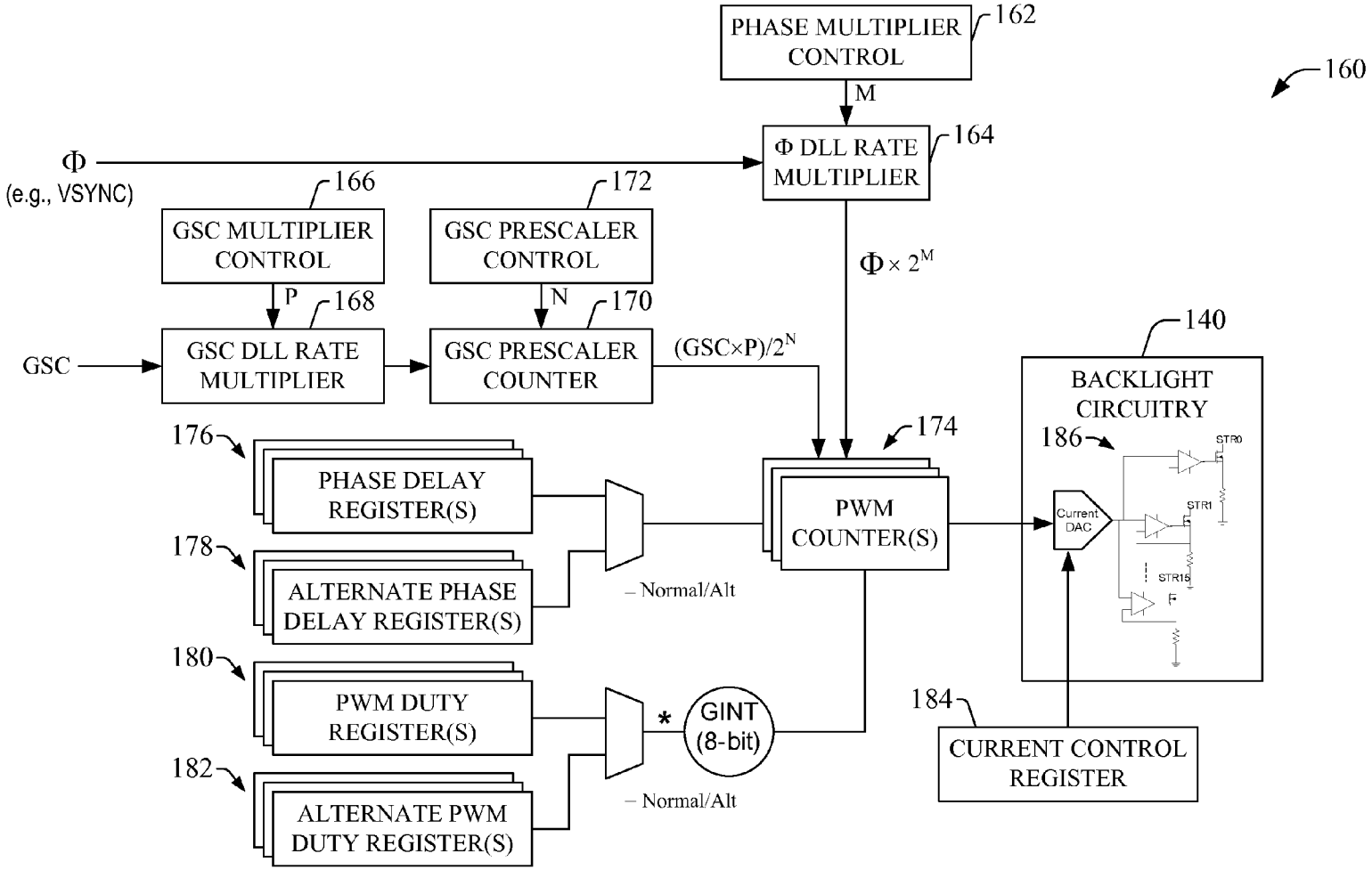
FIG. 1B is an example embodiment of the various functional elements of an example display controller and backlight circuitry in accordance with aspects herein.

Display controller 110 includes a timing signal generator component 112, also referred herein and in annexed drawings as timing generator 112, which produces clock signals utilized to scan the plurality of pixels in pixel circuitry 150. The clock signals can include vertical synchronization (VSYNC) signal and gate shift clock (GSC) signal. Timing signal generator 112 also can multiply the frequency of the clock signals to generate timing signals with higher frequency. Through multiplication of the frequency of at least one of the clock signals, the timing signal generator 112 can produce a timing signal that defines a sub-frame period for scanning a plurality of pixels that is part of pixel circuitry. Moreover, timing signal generator 112 can scale (or divide) the amplitude of one or more of the clock signals. In an example embodiment, e.g., 160 illustrated in FIG. 1B, timing signal generator 112 includes a phase multiplier control 162, also referred to as phase multiplier control component 162, that can output an M-bit (with M a natural number) multiplier for the a reference clock signal Φ, e.g., VSYNC. In embodiment 160, M is equal to 5 bits and thus the Φ can be multiplied up to a factor of $2^M=32$. The M-bit output is collected by Φ digital locked loop (DLL) rate multiplier, which produces the multiplied version of Φ: M×Φ. In addition, in example embodiment 160, timing signal generator 112 includes GSC multiplier control component 166, also referred to as GSC multiplier control 166, which supplies a P-bit (with P a natural number) register that allows multiplication of the GSC signal for a factor ranging from 1 to $2^P$; in example embodiment 160, P equals 5 bits.

GSC DLL rate multiplier 168 supplies a multiplied version of GSC signal, e.g., P×GSC, to GSC prescaler counter component 170, also referred to as GSC prescaler counter component 170, which collects N-bit output from GSC prescaler control component 172, also referred to as GSC prescaler control 172, and divides the multiplied signal by $2^N$. In an aspect, N equals 4 bit and the GSC signal can be divided by a factor of up to 16.

Timing signal generator 112 supplies processed (e.g., multiplied or scaled) clock signals to PWM counter component 120, also referred to herein as PWM counter component 120. Example embodiment 160 in FIG. 1B includes a set of one or more PWM counter(s) 174. If a multiplier greater than 1 is applied to clock signal Φ, such processed clock signal Φ can be employed to determine a sub-frame structure for rendering data in example display 100. In addition, processed (e.g., multiplied) clock signal Φ can be employed to internally configure a sequence of alternate sub-frame insertions or a sequence of alternate frame insertions, as described in greater detail below.

In an aspect of the subject innovation, alternate signal selector 114 can convey an indication (e.g., a data packet, a multi-bit word, a command . . . ) to timing signal generator 112 to configure, or select or define, internal generation of a sequence of PWM sub-frame insertions or a sequence of alternate PWM frame insertions. Such indication can be a request to timing signal generator 112 to generate an internal selection, or control, signal and supply such signal to PWM counter 120. In addition, alternate signal selector 114 can select a specific waveform (e.g., period in periodic waveform, amplitudes and various ON or OFF time intervals in a non-periodic waveform . . . ) for the internal selection signal and convey the selected waveform as part of the indication to timing signal generator 112. Alternate signal selector 114 can receive an external signal 115 to externally select, or define, a sequence of alternate sub-frame insertions or a sequence of alternate frame insertions. External signal 115 can be received in response to a request from alternate signal selector 114 to an external clock source (e.g., an external timing signal generator (not shown)). Alternate signal selector 116 can access configuration data within memory 132 in order to establish whether alternate PWM frame insertions or alternate PWM sub-frame insertions are defined through rising signal or lowering signal that are part of the selected internal control signal or the received external signal 114.

In another aspect of the subject disclosure, for either internally or externally selected, or configured, sequences of alternate PWM sub-frame insertions or alternate PWM frame insertions, alternate signal selector 116 can access one or more registers 134 in memory 132 to extract a phase delay for an alternate sub-frame or an alternate frame, and a phase delay for a normal sub-frame or frame. In addition, for an alternate sub-frame or frame, and a normal sub-frame or frame, phase signal generator component 116 can access memory 132 and extract from one or more registers 134 at least one value of one or more duty cycles for backlight illumination of the plurality of pixels in pixel circuitry. Phase signal generator component 116 is also referred to herein and annexed drawings as phase signal generator 116. In example embodiment 160, one or more phase delay register(s) 176 can embody a set of one or more register(s) 134, and include at least one value of phase delay for at least one normal sub-frame or frame. Likewise, one or more alternate phase delay register(s) 178 can embody a set of one or more register(s) 134, and include at least one value of phase delay for at least one alternate sub-frame or frame. In addition, one or more PWM duty register(s) 180 and one or more alternate PWM duty register(s) 182 embody a set of one or more register(s) 134, and determine, respectively, at least one value for a duty cycle of backlight illumination for at least one normal frame or sub-frame and at least one alternate sub-frame or frame.

In an aspect of the subject disclosure, driver controller 124 supply one or more values of alternate and normal phase delays and duty cycles to PWM counter 120 and implement, in part, one or more sequences of alternate sub-frame insertions or one or more sequences of alternate frame insertions. In addition, driver controller 124 can apply voltage(s) to backlight circuitry 140, and strings of LEDs therein, to turn on or off illumination in accordance with aspects described herein. In addition, based in part on one or more register(s) 134, e.g., current control register 184 in example embodiment 160, driver controller 124 can supply current(s) to backlight circuitry 140, and one or more LED strings 186 therein, to vary intensity of emitted light in the one or more LED strings when those turned on.

Figure 2:
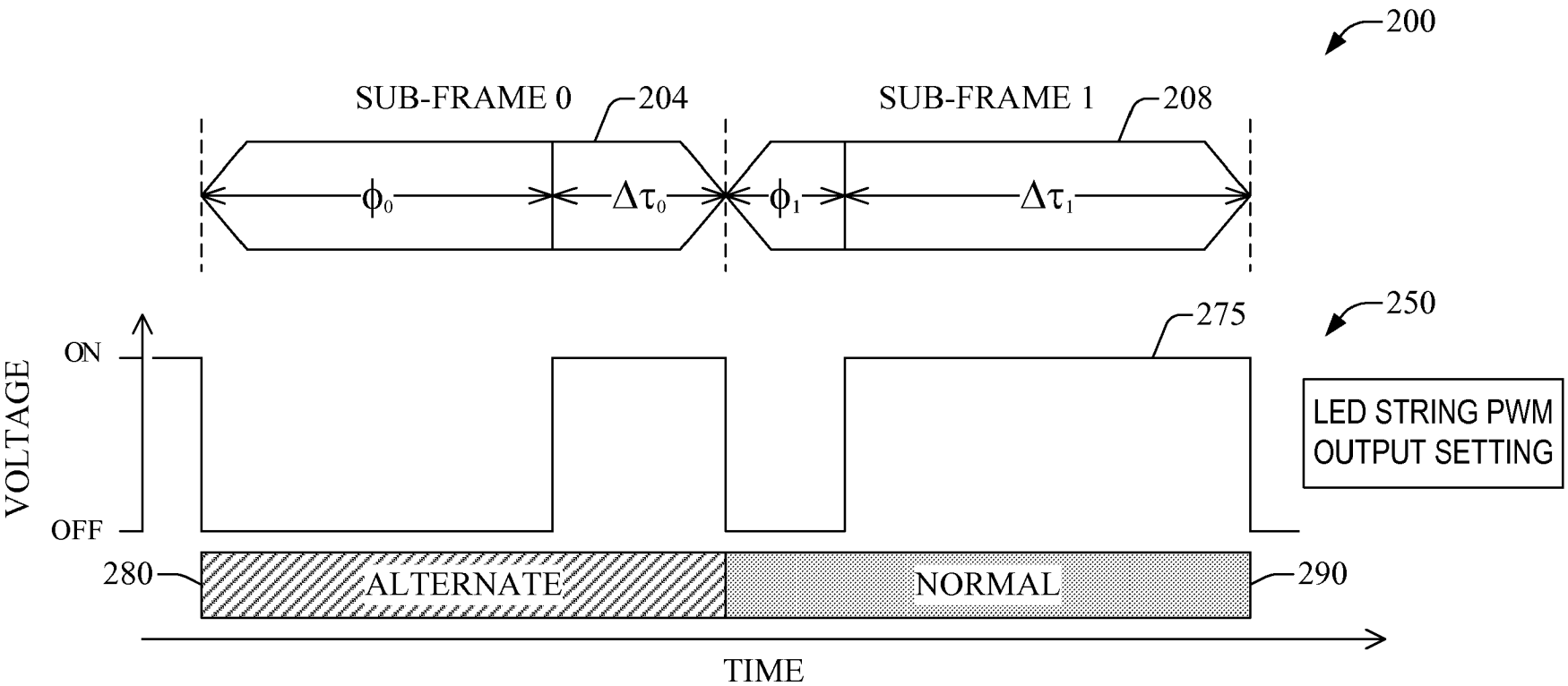
FIG. 2 illustrates a diagram of two sub-frames for rendering of an image in accordance with aspects described herein.
Figure 3A:
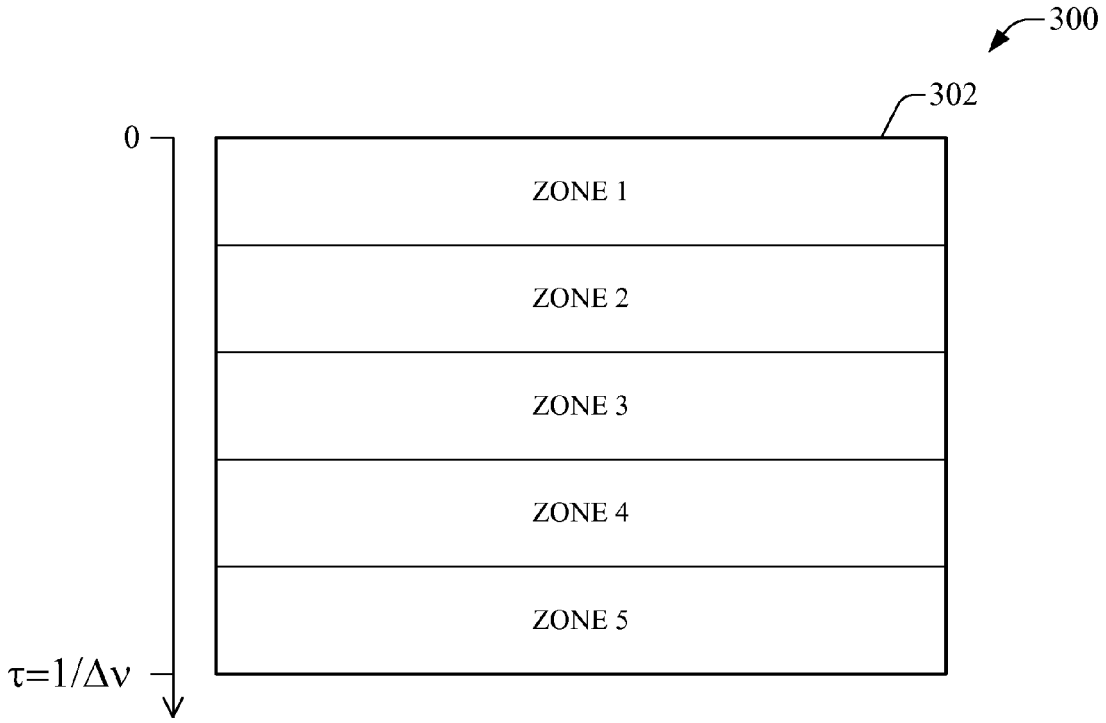
FIGS. 3A-3D represent various example partitions of a display area 910 in accordance with aspects described herein.
Figure 3B:
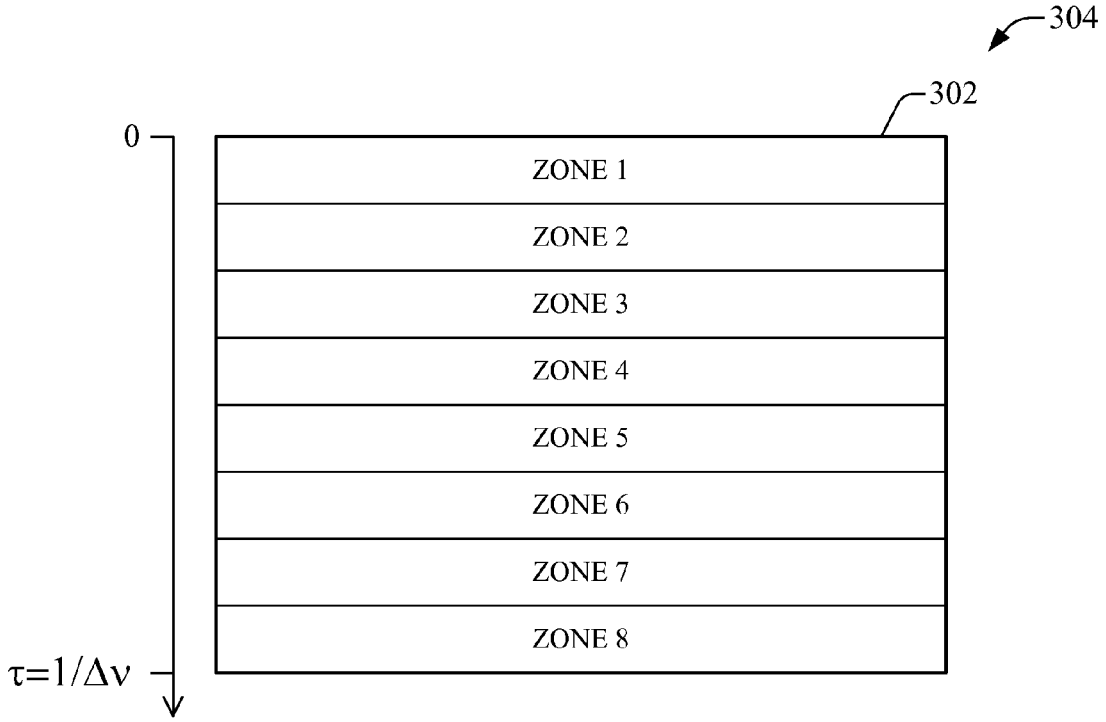
Figure 3C:
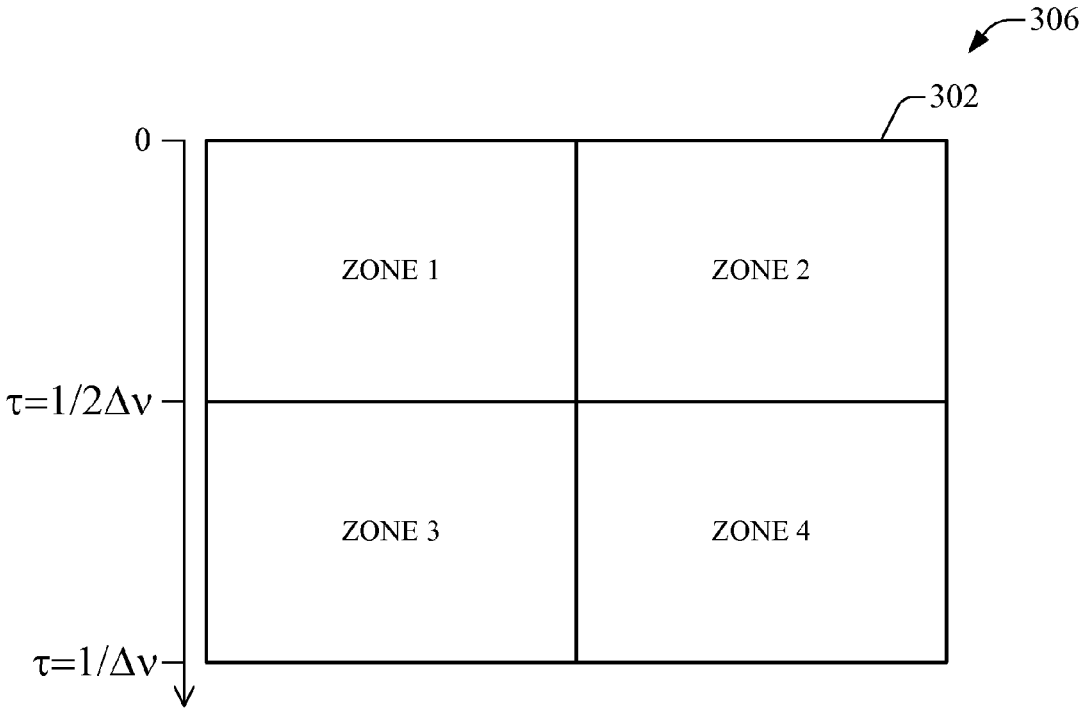
Figure 3D:
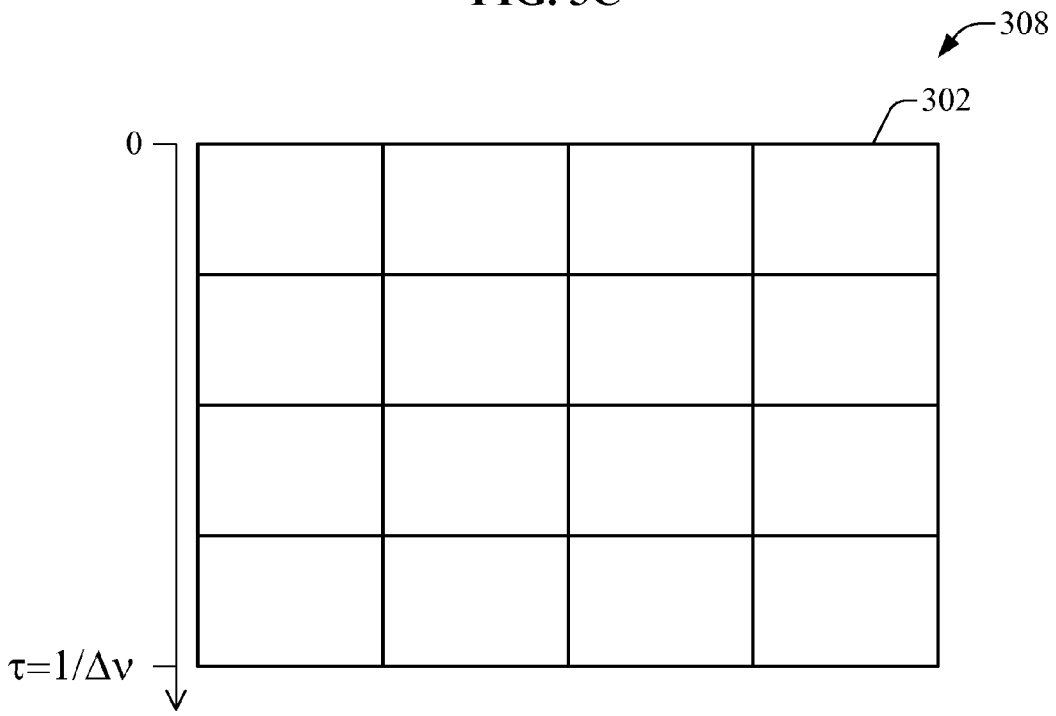

Features of alternate and normal sub-frames and frames are discussed next. FIG. 2 illustrates a diagram 200 of two sub-frames: sub-frame 0 204 and sub-frame 1 208, for rendering of an image in accordance with aspects described herein. In an aspect of the subject innovation, backlight for each sub-frame is regulated differently, as illustrated in diagram 250, which presents a LED string pulse-width output setting. For sub-frame 0 204, data associated with an image settles in a longer time-scale than in subsequent sub-frames, e.g., sub-frame 1. In particular, though not exclusively, for an applied voltage in a data line driving the capacitor associated with the pixel, voltage drop at the capacitor is established in a longer time span for the first sub-frame, e.g., sub-frame 0 204, than for a subsequent sub-frame, e.g., sub-frame 1. As an illustration, a time to nearly fully establish a voltage across the capacitor in a pixel can be substantially 3.47 μs.

In contrast to conventional backlight illumination approaches, which turn off backlight illumination of the first sub-frame for the duration of the sub-frame, in an aspect of the subject disclosure, the first sub-frame, e.g., sub-frame 0 204, backlight illumination is turned off for a portion of the first sub-frame while backlight illumination is turned on for the remainder of the duration of the sub-frame. As illustrated in diagrams 200 and 250, in an embodiment in which backlight illumination is implemented via one or more LED strings LEDs and regulated through PWM sequence, e.g., 275, for sub-frame 0 204, the one or more LED strings are turned off for an interval $\phi_0$ and turned on for an interval $\Delta\tau_0$, wherein the time to fully settle or nearly fully settle a pixel image, or data voltage, is $\tau=\phi_0+\Delta\tau_0$. In addition, for sub-frames subsequent to sub-frame 0 204, for example, sub-frame 1 208, in which the image (voltage) to be rendered (settled) is generally a variation of the image rendered in sub-frame 0 204, backlight illumination is turned off for an interval $\phi_1$ and turned on for an interval $\Delta\tau_1$, wherein the time to settle satisfy or substantially satisfy $\tau=\phi_1+\Delta\tau_1$. In an aspect, when backlight unit (e.g., set of LED strings and associated driver(s); backlight circuitry 140) is on, current supplied to one or more strings of LEDs can be adjusted (e.g., increased or decreased) to a desired value based on various factors, such as content—e.g., if low red content in data to be rendered, then string of red LEDs can be supplied with a low current, to establish a low intensity. In the subject disclosure, each of the values $\phi_0$ and $\phi_1$ is termed phase delay, and the ratio $\phi_\gamma/\phi_0$ amongst such delays satisfy $\phi_\gamma/\phi_0 \ll 1$. In the alternative or in addition, such ratio can satisfy $\phi_\gamma/\phi_0<1$.

In an example embodiment, $\tau=3.47$ μs or $\tau\approx3.47$ μs; such values are suitable for a single-pixel. Other values of τ are contemplated in the subject disclosure. In an aspect, such as alternative or additional values are dictated by a number of pixel lines, or gating lines. In typical LCD displays, spatial scale of a pixel is substantially smaller than typical length scale of backlight sources. In LED-based LCD displays, a single set of red, green, and blue LEDs can illuminate a plurality of pixels. In such scenario, insertion of alternate sub-frames or alternate frames (see below) is applied to one or more zones, each including a plurality of pixels. FIGS. 3A-3D represent various example zone partitions of a display area 302, or panel 302, in accordance with aspects described herein. LED string PWM output setting 275 can thus be applied to a set of one or more LED strings that illuminate a set of one or more pixel lines, or gating lines. Diagram 300 illustrates a partition in P=5 zones, each including n=N/5 pixel lines, wherein N (e.g., 1200) is the total number of pixel lines in the display. The illustrated display 302 has a refresh frequency $\Delta\nu$, which leads to a frame period $\tau=\Delta\nu^{-1}$. Accordingly, when inserting alternated a PWM sub-frames to regulate backlighting, the sub-frame period can be dictated by $(k\Delta\nu)^{-1}$, which correspond to time necessary to scan a zone. In an example, for $\Delta\nu$=240 Hz, $\tau\approx$4.167 ms. Similarly, diagram 304 illustrates a partition in eight zones, which results in regulation of backlight illumination of a smaller number of pixels. In such scenarios, backlight unit, e.g., set of one or more LED strings, is turned on after all pixels or substantially all pixels in a zone (e.g., zone 1) are settled.

Diagrams 306 and 308 present partitions in four and 16 tiles, respectively. Such partition allows regulation of backlight illumination in accordance with alternate sub-frame insertion described herein for sub-set of LED strings. In particular, though not exclusively, phase delays and duty cycles for alternate and normal sub-frames can vary from tile to tile. It should be appreciated that sub-frame time period in the presence of a tiled partition is determined by the number of vertical tiles: For example, in diagram 308, sub-frame period is $(4\Delta\nu)^{-1}$, which for $\Delta\nu$=240 Hz nearly equals 0.833 ms.

In an aspect, the larger the number P of zones in which the display area is divided, the higher the efficiency of the display with respect to duty cycle of the backlight unit (e.g., a set of LED strings and associated driver(s)) in the display. As discussed supra, at the single-pixel level (FIG. 2), which is electrostatically equivalent to a single line of pixels, duty cycle is 100% after phase delay elapses. As examples, for N=1000, K=5 results in effective duty cycle of substantially 80%, while for K=8 the effective duty cycle is substantially 87.5%.

It should be appreciated that in one or more embodiments in which Q−1 (with Q an natural number greater than unity) subsequent sub-frames are included (not shown), each of the sub-frames 1, 2, 3 . . . Q−1 can have respective phase delays $\phi_1\ \phi_2\ \phi_3 \ldots \phi_{Q-1}$. In an aspect, $\phi_\gamma<\phi_0$ ($\gamma$=1, 2, 3 . . . Q−1) and $\phi_1=\phi_2=\phi_3 \ldots \phi_{Q-2}=\phi_{Q-1}$. In addition or in the alternative, one or more subsets of elements in the set $\{\phi_1\ \phi_2\ \phi_3 \ldots \phi_{Q-1}\}$ can encompass equal elements with elements in different subsets being nearly equal, or substantially equal, rather than equal. Moreover, in the subject disclosure, for a set of Q sub-frames, one or more sub-frames can be alternate sub-frames; e.g., have a phase delay much smaller or smaller that the phase delay of the remaining sub-frames in the set In the subject disclosure, sub-frame 0 204, with phase delay $\phi_0$, is termed an alternate sub-frame, or grey sub-frame, whereas sub-frame 1 208 is termed a normal sub-frame. In the annexed drawings, such as FIG. 2, alternate sub-frames are represented as dashed rectangles (e.g., 280) and normal sub-frames are represented with grey rectangles (e.g., 290). Accordingly, in the subject disclosure, rendering of an image is based on insertion of an alternate sub-frame instead of a black sub-frame (a sub-frame in which backlight is turned off for the duration of the sub-frame). Yet, it should be appreciated that in an aspect of the subject disclosure, an alternate sub-frame (or an alternate frame; see below) also can be configured to be a black sub-frame. An image, or data associated therewith, to be rendered determines if an alternate frame or sub-frame is to be configured as a black sub-frame; for instance, if data is zero an alternate frame or sub-frame can be configured to be black; whereas non-black, or grey, alternate frames or sub-frames are configured and utilized when data is finite or non-null. Alternate frame(s) also can be configured to be black frame(s) based at least in part on data.

In the subject disclosure, for a set of Q sub-frames, the set of respective Q phase delays $\phi_1$, $\phi_1$, $\phi_2$, $\phi_3$ . . . $\phi_{Q-1}$ are configurable and can be static, e.g., fixed for a rendering session, such as a video session, or dynamic, e.g., variable throughout a video session. In an aspect, in a panel such as 302 in diagram 300, each string of LEDs that are part of backlight circuitry 140 typically illuminates a zone in the panel 302; consecutive zones of the panel 302 can have different phase delays associated with the spatial location of the string of LEDs within the panel 302. Duty cycle associated with LED string PWM output setting also can be configurable, adopting static value(s) or dynamic values(s). Duty cycle of LED string PWM output setting for normal sub-frame can be different from duty cycle of LED string PWM output setting for alternate sub-frame. It is noted that in the subject disclosure duty cycle is defined as the duty cycle of a PWM train of pulses after a phase delay is applied; in this manner, in an aspect, the duty cycle thus refer to duty cycle of backlight illumination. In the example depicted in diagram 200, alternate sub-frame 280 duty cycle is 100%, and so is the duty cycle of normal frame 290.

Figure 4:
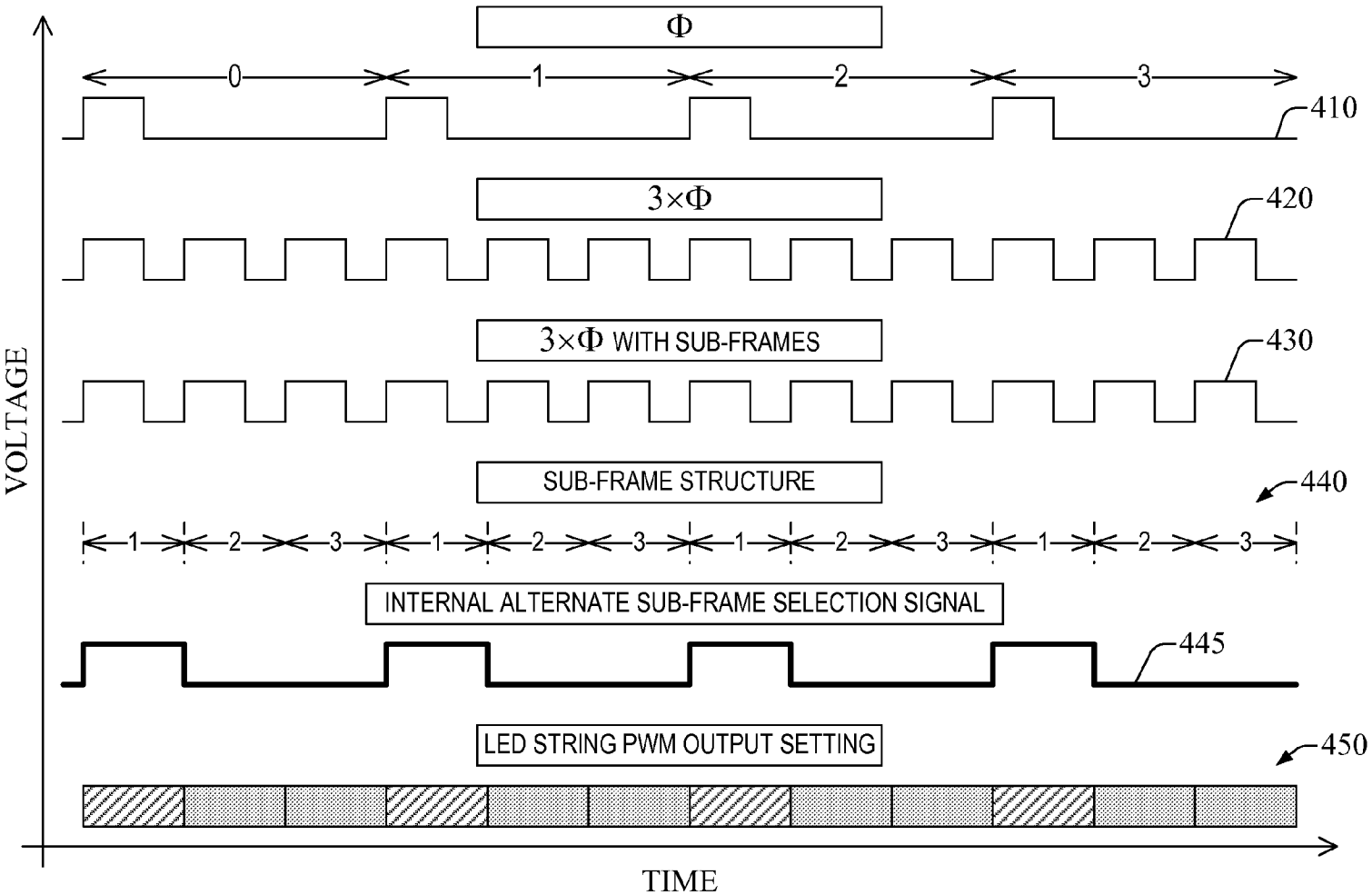
FIGS. 4-5 illustrate example sequences of inserted alternate PWM sub-frames in internal mode in accordance with features of the subject disclosure.
Figure 5:
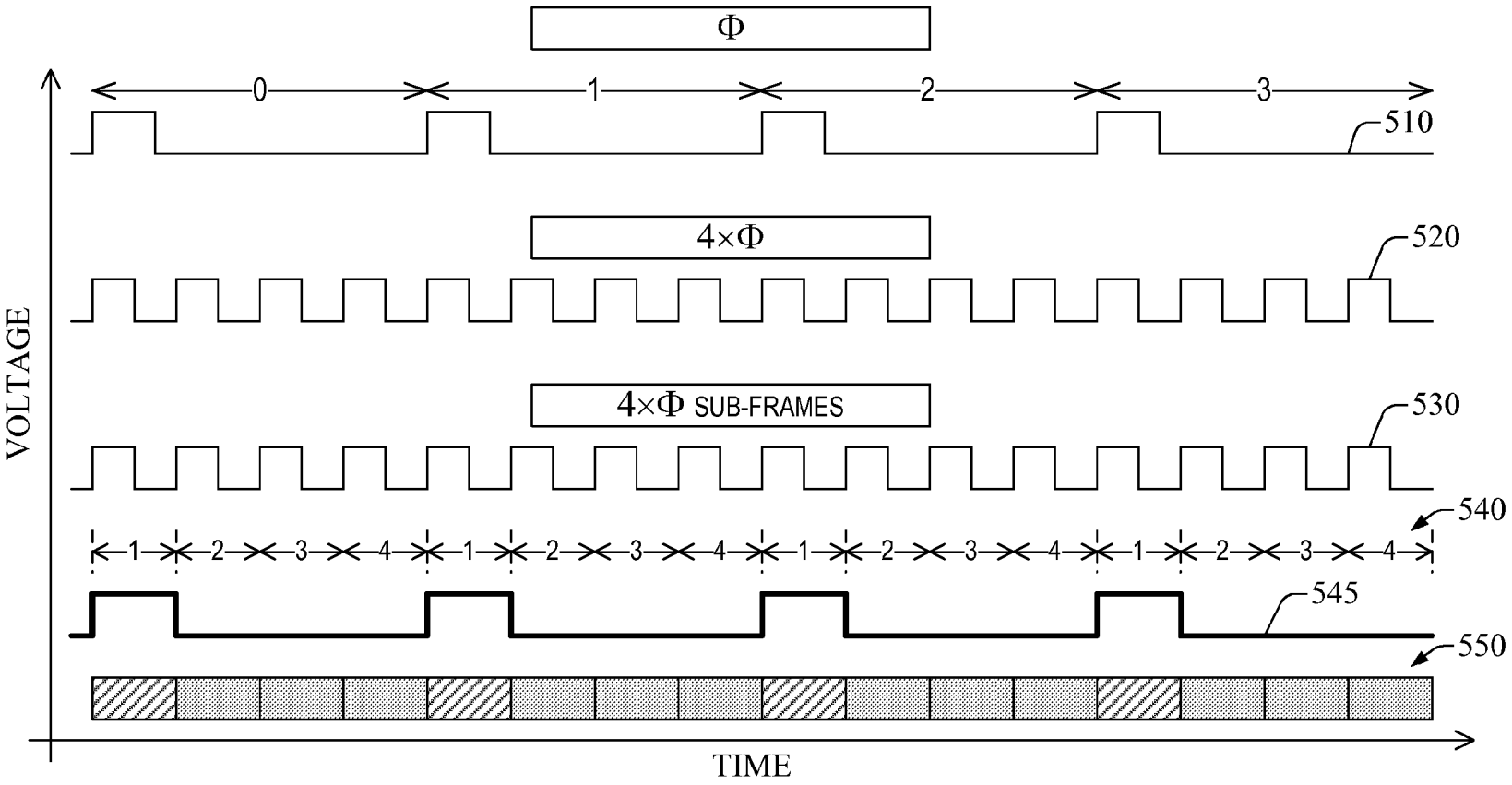

In one or more embodiments or scenarios, a sequence of alternate sub-frames can be implemented in internal mode, wherein the first sub-frame in a set of one or more Q sub-frames is automatically configured as an alternate sub-frame. For example, automatic configuration of the first sub-frame as an alternate sub-frame can be accomplished through an alternate PWM phase signal in which first input rise (e.g., voltage rise) in a PWM sequence can enable configuration of the first sub-frame as an alternate sub-frame. In one or more scenarios, an internal alternate sub-frame selection, or control, signal can configure the first sub-frame as an alternate sub-frame; as discussed supra, such internal alternate sub-frame selection, or control, signal can be selected by alternate signal selector 114 and issued, or generated, by timing signal generator 112. FIG. 4 illustrates a sequence of inserted PWM sub-frames in internal mode. Raster reference signal $\Phi$ 410 is multiplied by a factor of 3 to lead to a multiplied raster PWM signal 3×$\Phi$ 420, which provides reference signal 3×$\Phi$ 430 for rendering content with a 3-sub-frame structure 440. As discussed supra, internal alternate sub-frame selection, or control, signal 345 configures the first sub-frame in multiplied reference signal 3×$\Phi$ 430 as an alternate sub-frame while second and third sub-frames are normal sub-frames. Similarly, in FIG. 5 a reference signal (e.g., VSYNC) $\Phi$ 510 is multiplied by a factor of 4 to lead to a multiplied raster PWM signal 4×$\Phi$ 520, which provides reference signal 4×$\Phi$ 530 for rendering content with a 4-sub-frame structure 540. Signal 545 is an internal alternate sub-frame selection, or control, signal that configures, automatically, a sequence of alternate sub-frames in LED string PWM output setting 550 in which the first sub-frame in a frame is an alternate sub-frame.

Figure 6:
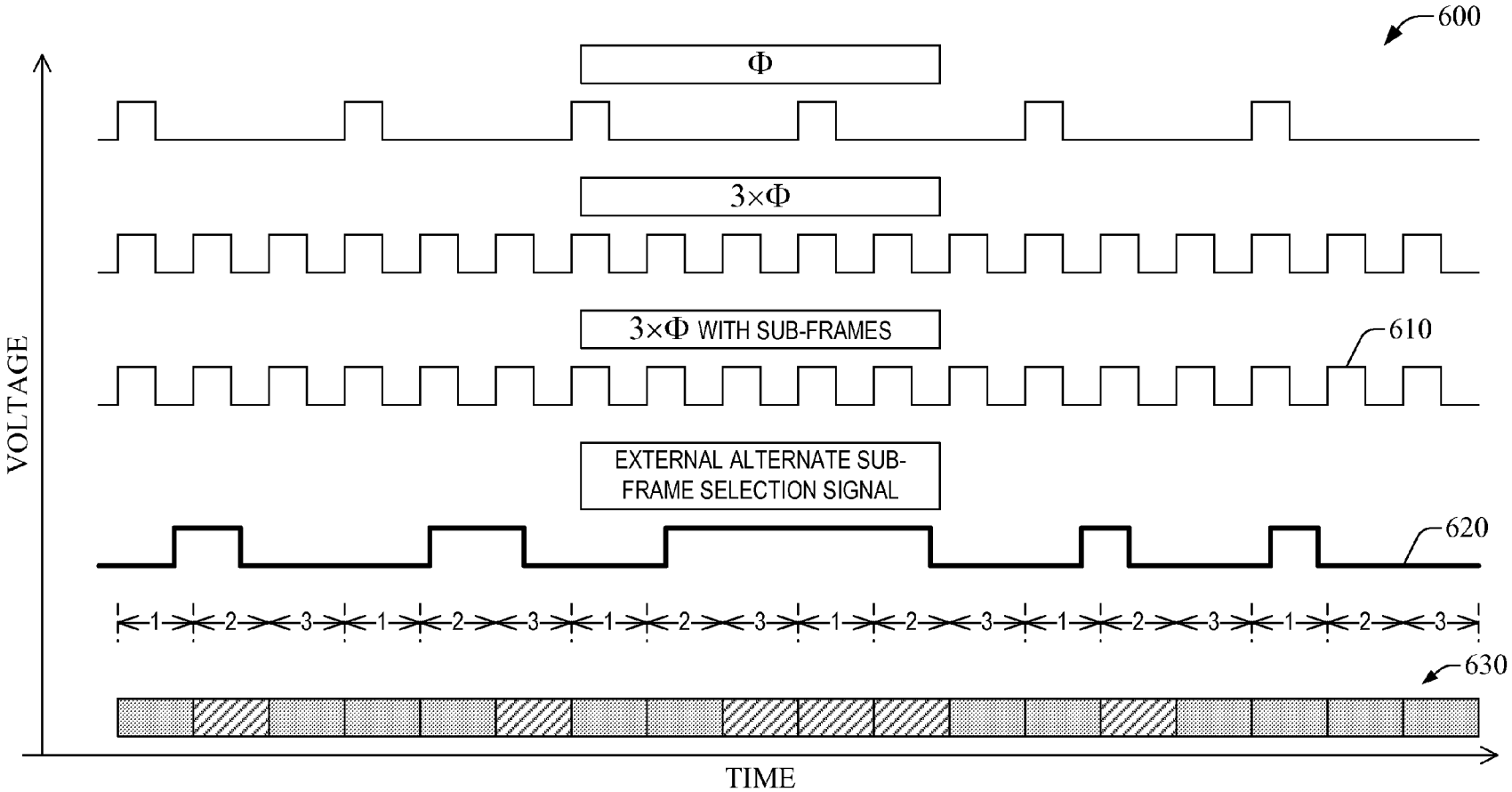
FIG. 6 displays a diagram of an example sequence of inserted PWM sub-frames in external mode in accordance with aspects of the subject disclosure.

In additional or alternative one or more scenarios, a sequence of alternate sub-frames can be implemented in external mode, wherein one or more sub-frames in a set of one or more Q sub-frames is configured as an alternate sub-frame based on an external alternate PWM phase signal. For example, e.g., for "ON" state of the external alternate PWM phase signal enables (e.g., triggers) configuration of a subsequent sub-frame as an alternate sub-frame. For example, FIG. 6 displays a diagram of an example sequence of inserted PWM sub-frames 630 in external mode in accordance with aspects described herein. In diagram 600, a reference signal 3×Φ 630 establishes a rendering timing signal with 3-sub-frame structure (e.g., illustrated with contiguous arrows). External alternate sub-frame selection, or control, signal 620 produces a sequence of inserted alternate PWM sub-frames which is not periodic and wherein alternate sub-frames (represented as dashed rectangles) are configured when the external phase signal 520 is "ON" (or "High") value and the frame configured to alternate frame is subsequent to a normal frame. In an aspect, the illustrated external alternate sub-frame selection, or control, signal 620 leads to multiple contiguous alternate sub-frames, each of such contiguous sub-frames can be associated with rendering of new data in a display that exploits insertion of alternate sub-frames as described herein.

Figure 7:
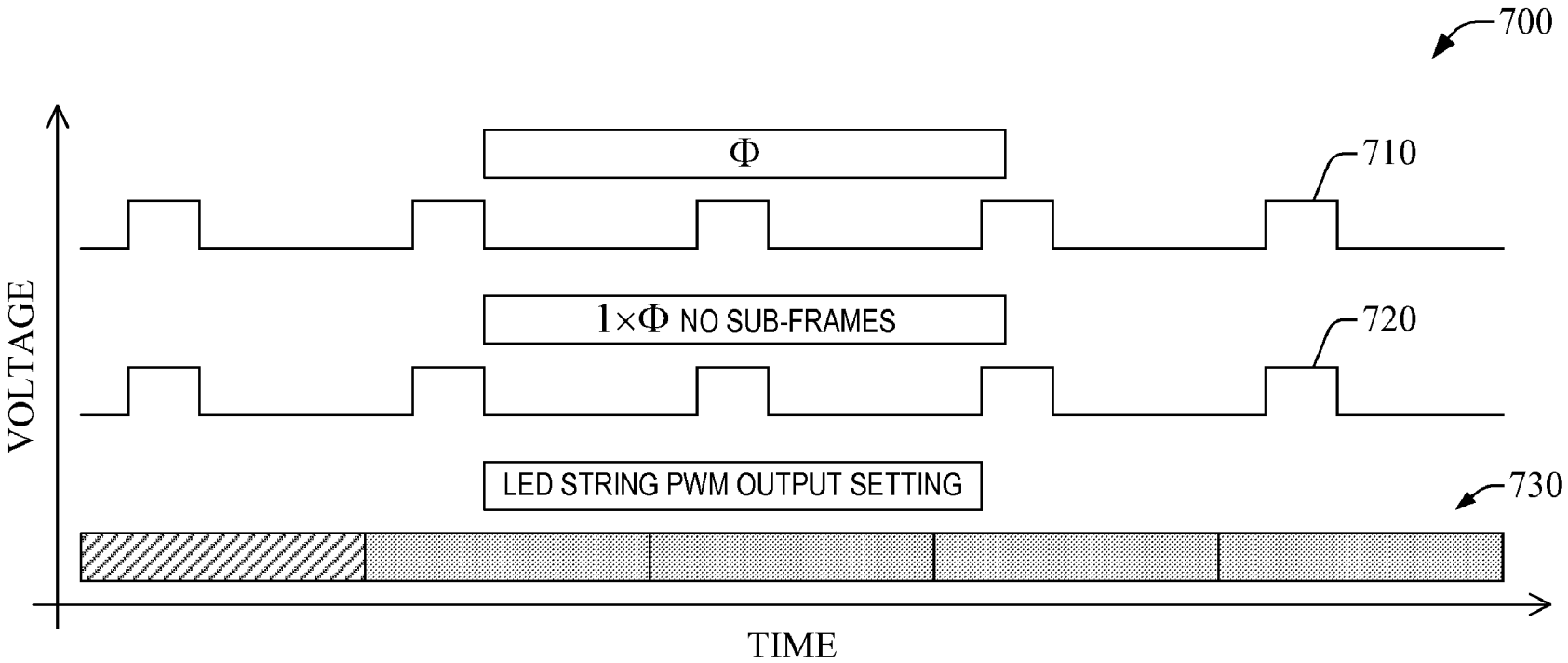
FIGS. 7-8 illustrate example scenarios in which rendering of image(s) does not rely, at least in part, on a sub-frame structure in accordance with aspects described herein.
Figure 8:
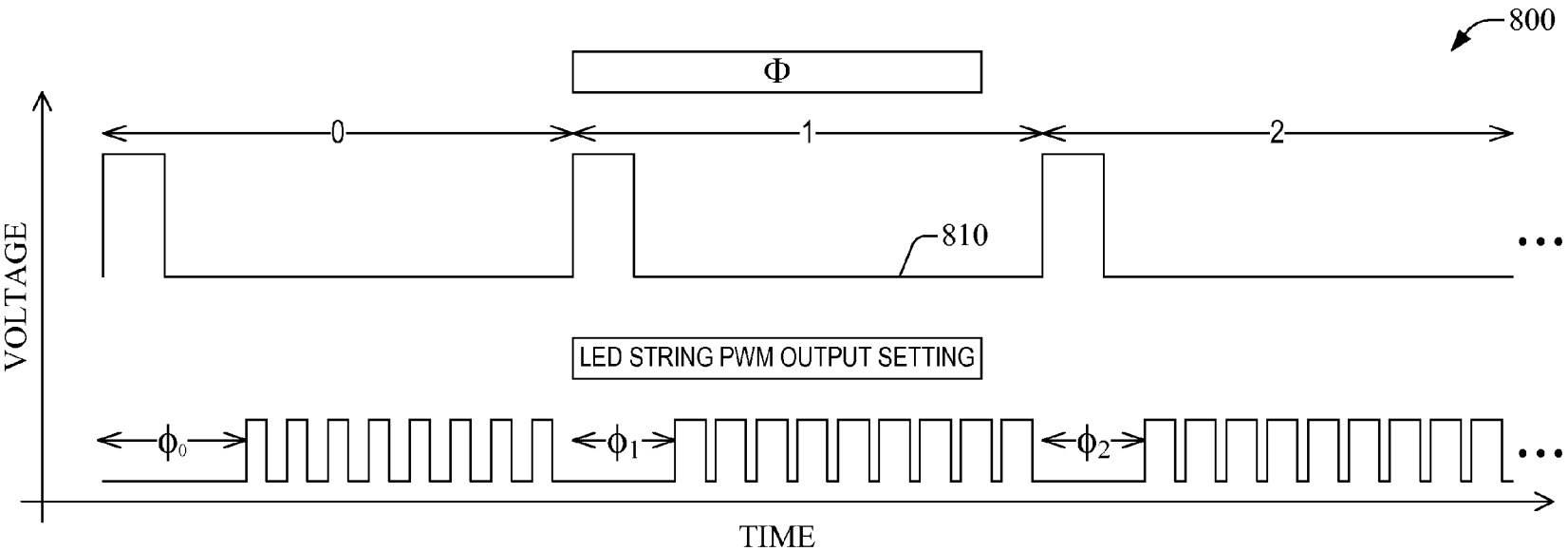

It should be appreciated that insertion of alternate PWM sub-frame can be adjusted for implementation in one or more scenarios in which image rendering does not rely on sub-frame rendering. In such scenarios or embodiments, an alternate frame can be inserted amongst a sequence of normal frames, wherein as in the case of alternate sub-frames, an alternate frame includes a phase delay $\phi^{(alt)}$ and a PWM trains of pulses with duty cycle $\eta^{(alt)}$, while a normal frame includes a phase delay $\phi^{(normal)}$ and an associated duty cycle $\eta^{(normal)}$. FIGS. 7 and 8 illustrates an example scenario in which rendering of image(s) does not rely, at least in part, on a sub-frame structure. In diagram 700, a raster reference PWM signal Φ 710, e.g., vertical synchronization (VSYNC) signal is multiplied by a unity multiplier which results in a raster PWM signal 1×Φ 720 without sub-frames (in view of the unity multiplier). Note that in diagram 800 the unity multiplied raster PWM signal 1×Φ. In addition, in diagram 700, sequence of alternate frames 830 includes a single alternate frame, which is the first frame in a scan if new content, e.g., a new data, is rendered. As illustrated in diagram 800, in a similar scenario with a raster reference signal Φ 810, the first frame is an alternate frame represented with a PWM output setting with a phase delay $\phi$ and duty cycle of 50%, while subsequent frames are normal frames with phase delay $\phi_1$, $\phi_2$, etc., and duty cycle of 50% as well. While as illustrated in diagram 800 $\phi_1=\phi_2$ and duty cycle is $\eta_1=\eta_2=75\%$, in one or more embodiments $\phi_1$ can be different from $\phi_2$. Similarly, $\eta_1$ can be different from $\eta_2$. As discussed for rendering scenarios that rely on sub-frames, duty cycle of an alternate frame or a normal frame is configurable, and so is the phase delay of an alternate frame or a normal frame. In an aspect, such duty cycle or phase delay can be configured to be static or dynamic.

Figure 9:
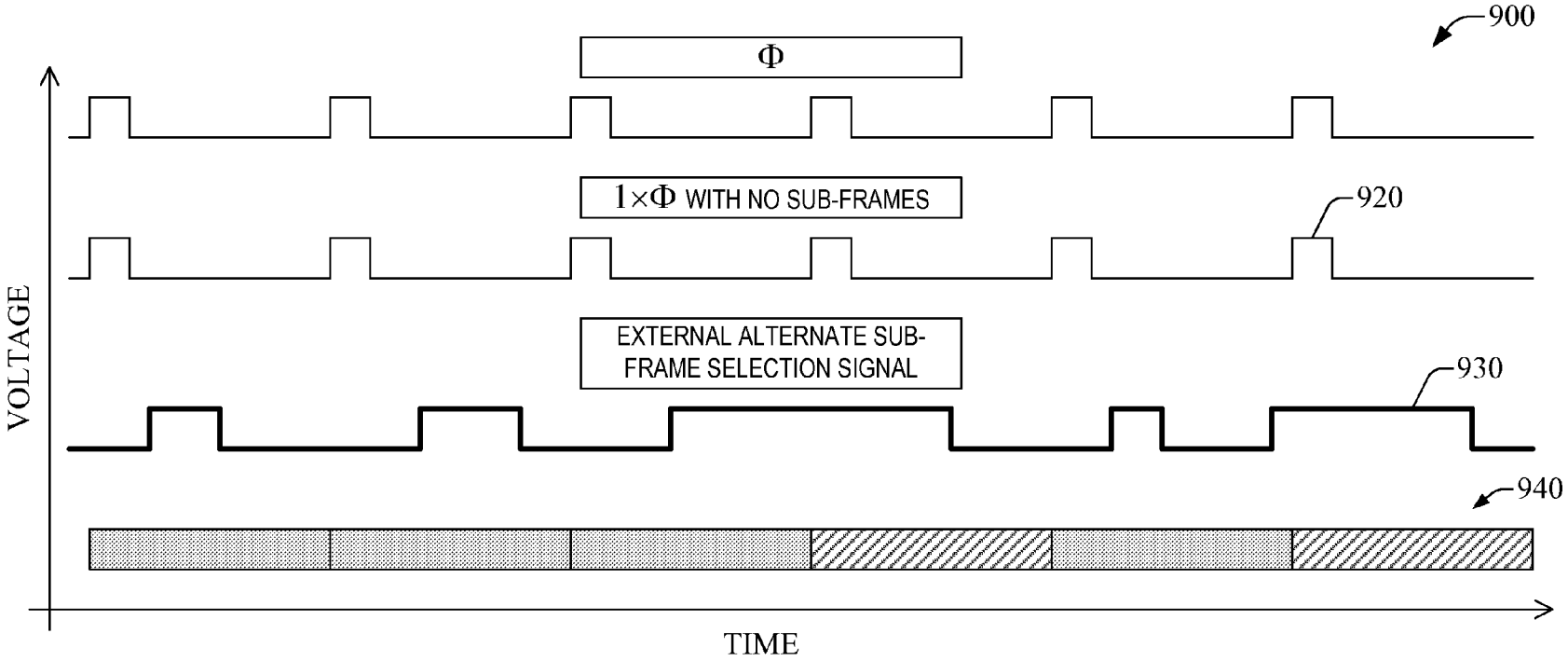
FIG. 9 displays a diagram of an example sequence of inserted PWM frames in external mode in accordance with features described herein.

For example, FIG. 9 displays a diagram of an example sequence of inserted PWM frames in external mode in accordance with aspects described herein. In diagram 800, a reference signal 1×Φ 810 establishes a rendering timing signal without sub-frame structure. External phase signal 830 results in a sequence of inserted PWM frames which is not periodic and wherein alternate frames (represented as dashed rectangles, as indicated supra) are configured when the external phase signal 830 is "ON" (or "High") value and the frame configured to alternate frame is subsequent to a normal frame.

To implement the various features or aspects described supra, display controller 110 includes processor(s) 128. In addition, display controller 110 also can include input/output (I/O) component(s) (not shown) that can enable configuration of various registers and other values of display controller 110 through exchange of data, such as external signal 114. In an aspect, processor(s) 128 can be configured to provide or can provide, at least in part, the described functionality of display controller 110 or one or more functional elements (e.g., components) therein. In an aspect, to provide such functionality, processor(s) 128 can exploit bus 135 to exchange data or any other information amongst functional elements (components, multipliers, etc.) within display controller and memory 132 or elements therein, such as register(s) 134. Bus 135 can be embodied in at least one of a memory bus, a system bus, an address bus, a message bus, or any other conduit, protocol, or mechanism for data or information exchange among components that execute a process or are part of execution of a process. The exchanged information can include at least one of code instructions, code structure(s), data structures, or the like.

Processor(s) 128 also can execute code instructions (not shown) stored in memory 132 to implement or provide at least part of the described functionality of display controller 110. Such code instructions can include program modules or software or firmware applications that implement specific tasks which can be accomplished through one or more of the methods described in the subject specification and that are associated, at least in part, with functionality or operation of example display 100. In one or more alternative or additional embodiment(s), processor(s) 128 can be distributed amongst one or more functional elements (components, multipliers, counters, etc.) of display controller. Further, in some embodiments, one or more of the functional elements of display controller 110 can be implement as software or firmware and can reside within memory 132 as one or more sets of code instructions that, when executed by processor(s) 128, implement such functional elements (components, multipliers, counters, etc.) and described functionality thereof.

In one or more embodiments, display controller 110 can be either a general microcomputer or a special purpose microcomputer. Display controller 110 can be implemented on a single integrated circuit (IC) chip or on multiple IC chips. In addition, through provision of code instructions to memory 132, display controller 110 can be programmable. In the alternative, display controller 110 can be non-programmable and operate in accordance with aspects herein as established at manufacturing time. In view of the foregoing it is readily appreciated that the display controller 110 can be implemented in hardware, software, or firmware.

As described herein, at least an advantage of insertion of alternate sub-frame is efficient utilization of image data in a display. At least another advantage is mitigation of image motion blur without insertion of a black sub-frame. In addition, as described herein, at least one advantage of insertion of an alternate frame in scenarios in which no sub-frame structure is implemented is the mitigation of flickering of static images rendered in an LCD display.

Figure 10:
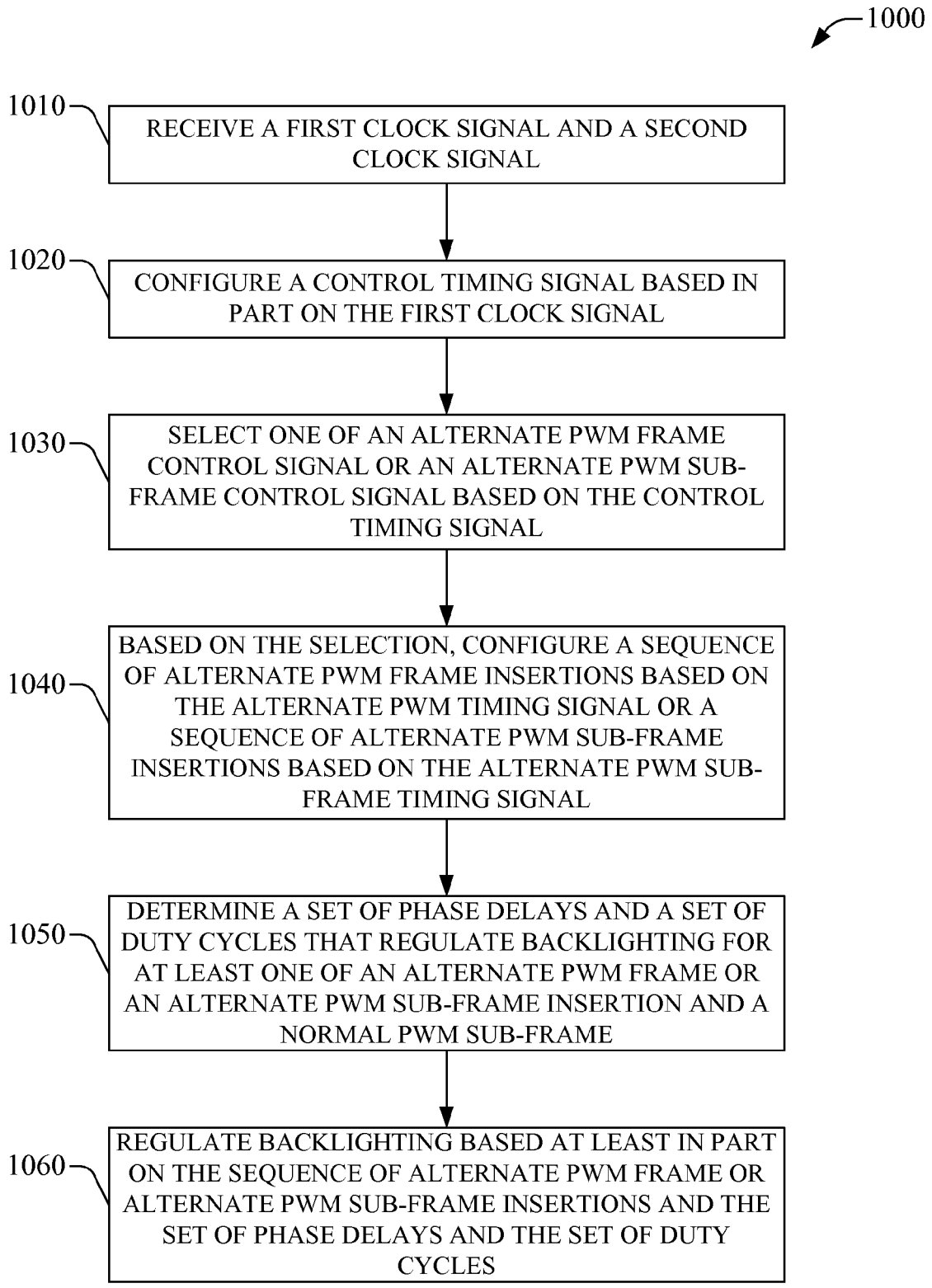
FIG. 10 is a flowchart of an example method for inserting at least one of alternate sub-frames or frames to control backlight illumination during data rendering in an illumination systems that exploit LED-based backlighting in accordance with aspects described herein.

In view of the example system(s) described above, example method(s) that can be implemented in accordance with the disclosed subject matter can be better appreciated with reference to flowchart in FIG. 10. For purposes of simplicity of explanation, example methods disclosed herein are presented and described as a series of acts; however, it is to be understood and appreciated that the disclosed subject matter is not limited by the order of acts, as some acts may occur in different orders and/or concurrently with other acts from that shown and described herein. For example, one or more example methods disclosed herein can alternatively be represented as a series of interrelated states or events, such as in a state diagram. Moreover, interaction diagram(s) may represent methods in accordance with the disclosed subject matter when disparate entities enact disparate portions of the methodologies. Furthermore, not all illustrated acts may be required to implement a described example method in accordance with the subject specification. Further yet, two or more of the disclosed example methods can be implemented in combination with each other, to accomplish one or more features or advantages described herein.

Method(s) disclosed throughout the subject specification and annexed drawings are capable of being stored on an article of manufacture to facilitate transporting and transferring such method(s) to computers or chipsets with processing capability(ies) for execution, and thus implementation, by a processor, or for storage in a memory. In an aspect, one or more processors that enact method(s) described herein can be employed to execute code instructions retained in a memory, or any computer- or machine-readable medium, to implement method(s) described herein; the code instructions, when executed by the one or more processor implement or carry out the various acts in the method(s) described herein. The code instructions provide a computer- or machine-executable framework to enact the method(s) described herein.

FIG. 10 is a flowchart of an example method 1000 for inserting at least one of alternate sub-frames or frames to control backlight illumination during data rendering in an illumination systems that exploit LED-based backlighting in accordance with aspects described herein. In an aspect, the subject example method 1000 can be enacted by display controller 110, or one or more functional elements described therein in accordance with aspects described supra. In addition or in the alternative, processor(s) that provide at least part of the functionality of display controller 110, or the one or more functional elements therein, also can enact the subject example method 1000. At act 1010, a first clock signal and a second clock signal are received. In an aspect, the first clock signal can be a VSYNC signal (e.g., reference signal Φ) while the second clock signal can be a GSC signal. At act 1020, a control timing signal based in part on the first clock signal is configured. In an aspect, the control timing signal determines a set of sub-frames for the first clock signal; see, e.g., 3×Φ or 4×Φ signals supra. Configuration can be implemented, for example, by multiplying the first clock signal with a predetermined, configurable multiplier. For example, Φ DLL multiplier 164 can effect the multiplication. A parameter (e.g., M) that defines a numbers of bits determines the range of possible multiplication. Multiplier can be configurable. Disparate imaging (e.g., video) sessions in a single display (e.g., example display 100) can be controlled in accordance with disparate multipliers. At act 1030, one of an alternate PWM frame control signal or an alternate PWM sub-frame control signal based on the control timing signal is selected. Such selection can be based in part on the number of sub-frames defined by the control timing signal: for null number of sub-frames, e.g., control timing signal results from multiplication of the first clock signal with unity multiplier, the alternate PWM frame control signal is selected. In the alternative, for a finite number of sub-frames, e.g., in the case multiplier of the first clock signal is finite, the alternate PWM sub-frame control signal is selected. In an aspect, selecting at least one of the alternate PWM frame control signal or the alternate PWM sub-frame control signal can be accomplished internally, e.g., within the digital controller that enacts the subject method; for example, the selecting act can be effected by replicating the control timing signal and adopting (e.g., configuring) the replicated signal as the alternate PWM frame control signal or the alternate PWM sub-frame control signal. In another aspect, selecting at least one of the alternate PWM frame control signal or the alternate PWM sub-frame control signal can be can accomplished externally, e.g., by receiving an external timing signal (e.g., external signal 114) and configuring the alternate PWM frame control signal or the alternate PWM sub-frame control signal as the received external timing signal.

At act 1040, based on the selection in act 1030, a sequence of alternate PWM frame insertions based on the alternate PWM frame control signal or a sequence of alternate PWM sub-frame insertions based on the alternate PWM sub-frame control signal is configured. Internally or externally established alternate PWM frame or alternate PWM sub-frame control signals can be utilized to configure at least one of the alternate PWM frame insertions sequence or alternate PWM sub-frame insertions sequence. At act 1050, a set of phase delays and a set of duty cycles that regulate backlighting for (i) at least one of an alternate PWM frame insertion or an alternate PWM sub-frame insertion, and (ii) at least one of a normal PWM sub-frame or a normal PWM frame are determined. At act 1060, backlighting in a display is regulated based at least in part on (a) the sequence of alternate PWM frame insertions or alternate PWM sub-frame insertions or (b) the set of phase delays and the set of duty cycles.

Various aspects of the subject disclosure can be automated via, at least in part, artificial intelligence (AI) methodologies, which enable inference, e.g., reasoning and conclusion synthesis based upon a set of metrics, arguments, or known outcomes in controlled scenarios, or training sets of data, of various parameters, e.g., phase delay(s), duty cycles, suitable number of zones for backlight regulation, or the like. Artificial intelligence methods or techniques referred to herein typically apply advanced mathematical algorithms—e.g., decision trees, neural networks, regression analysis, principal component analysis (PCA) for feature and pattern extraction, cluster analysis, genetic algorithm, or reinforced learning—to a data set. Such methodologies can be retained in memory 132. As an example, Hidden Markov Models (HMMs) and related prototypical dependency models can be employed. General probabilistic graphical models, such as Dempster-Shafer networks and Bayesian networks like those created by structure search using a Bayesian model score or approximation can also be utilized. In addition, linear classifiers, such as support vector machines (SVMs), non-linear classifiers like methods referred to as "neural network" methodologies, fuzzy logic methodologies can also be employed. Moreover, game theoretic models (e.g., game trees, game matrices, pure and mixed strategies, utility algorithms, Nash equilibria, evolutionary game theory, etc.) and other approaches that perform data fusion, etc., can be exploited.

As used herein, the term "relative to" means that a value A established relative to a value B signifies that A is a function of the value B. The functional relationship between A and B can be established mathematically or by reference to a theoretical or empirical relationship. As used herein, coupled means directly or indirectly connected in series by wires, traces or other connecting elements. Coupled elements may receive signals from each other.

In the subject specification, terms such as "store," "data store," data storage," and substantially any term(s) that convey other information storage component(s) relevant to operation and functionality of a functional element or component described herein, refer to "memory components," or entities embodied in a "memory" or components comprising the memory. The memory components described herein can be either volatile memory or nonvolatile memory, or can include both volatile and nonvolatile memory.

By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of further illustration and not limitation, RAM can be available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

The various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs usually reproduce data optically with lasers. Combinations of the above should also be included within the scope of computer-readable media.

While the foregoing disclosure discusses illustrative aspects and/or embodiments, it should be noted that various changes and modifications could be made herein without departing from the scope of the described aspects and/or embodiments as defined by the appended claims. In addition, although elements of the described aspects and/or embodiments may be described or claimed in the singular, the plural is contemplated unless limitation to the singular is explicitly stated. Moreover, all or a portion of any aspect and/or embodiment may be utilized with all or a portion of any other aspect and/or embodiment, unless stated otherwise. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A display, comprising:

a plurality of pixels partitioned in a set of groups of one or more pixel rows;

backlight circuitry comprising a backlight unit that includes a set of light emitting diode (LEDs) strings; and a display controller that configures a sequence of one or more sub-frames or a sequence of one or more frames to update the plurality of pixels, wherein for the sequence of one or more sub-frames, at least one sub-frame in the sequence includes a first phase delay in which the backlight unit is turned off and a first pulse-width modulation (PWM) sequence that regulates operation of the backlight unit; and the phase delay is longer than respective phase delays of the one or more sub-frames in the sequence excluding the at least one sub-frame.

2. The display of claim 1, wherein, for the sequence of one or more frames, at least one frame in the sequence includes a second phase delay in which the backlight unit is turned off and a second pulse-width modulation (PWM) sequence that regulates operation of the backlight unit; and the phase delay is longer than respective phase delays of the one or more frames in the sequence excluding the at least one frame.

3. The display of claim 2, wherein the display controller includes a timing signal generator that produces a timing signal that defines a first period of one or more sub-frames in the sequence of one or more sub-frames or a second period of one or more frames in the sequence of one or more frames, wherein the first period or the second period is a fraction of a disparate period of a reference timing signal.

4. The display of claim 3, wherein the reference timing signal is a vertical synchronization (VSYNC) clock signal of the display.

5. The display of claim 2, wherein the display controller includes a phase signal generator that configures at least one of the phase delay and a duty cycle for at least one of the first PWM sequence and the second PWM sequence.

6. The display of claim 5, wherein, the display controller includes an alternate signal selector that conveys an indication to the timing signal generator to insert the at least one sub-frame in the sequence of one or more sub-frames with the disparate period, wherein the indication supplies a selection of an internal control signal that defines the sequence of one or more sub-frames.

7. The display of claim 5, wherein, the alternate signal selector receives an external timing signal that defines at least in part at least one of the sequence of one or more sub-frames or the sequence of one or more frames.

8. The display of claim 7, wherein the display controller includes a phase signal generator that configures the respective phase delays of the one or more sub-frames in the sequence excluding the at least one sub-frame.

9. The display of claim 8, wherein the phase signal generator configures the respective phase delays of the one or more frames in the sequence excluding the at least one frame.

10. The display of claim 8, wherein the phase signal generator configures a duty cycle value for a third PWM sequence for the one or more sub-frames in the sequence excluding the at least one sub-frame.

11. The display of claim 10, wherein the phase signal generator configures a duty cycle value for a fourth PWM sequence for the one or more frames in the sequence excluding the at least one frame.

12. The display of claim 1, wherein the display controller includes a memory that retains a set of registers comprising at least one of a set of phase delay values and a set of duty cycle values.

13. A method, comprising:

configuring a control timing signal by multiplying a clock signal with a multiplier component;

selecting one of an alternate pulse-width modulation (PWM) frame control signal or an alternate PWM sub-frame control signal based on the control timing signal;

based on the selection, configuring a sequence of alternate PWM sub-frame insertions based on the phase signal;

based on the configuration, determining one of a first set of phase delay values and a first set of duty cycle values that regulate backlighting in a display for an alternate PWM sub-frame insertion in the sequence, or a second set of phase delay values and a second set of duty cycle values that regulate backlighting in a display for an alternate PWM frame insertion in the sequence; and regulating backlighting in the display based at least in part on at least one of (i) the sequence of alternate PWM sub-frame insertions and the first set of phase delay values and the first set of duty cycle values, or (ii) the sequence of alternate PWM frame insertions and the set of phase delay values and the set of duty cycle values.

14. The method of claim 13, wherein selecting the alternate PWM frame control signal includes selecting a first internal control signal or a first external control signal.

15. The method of claim 14, wherein selecting the first internal signal includes configuring the control timing signal as the alternate PWM frame control signal.

16. The method of claim 14, wherein selecting the first external signal includes:

receiving an external signal; and configuring the external signal as the alternate PWM frame signal.

17. The method of claim 14, wherein selecting the second external signal includes:

receiving an external signal; and configuring the external signal as the alternate PWM sub-frame signal.

18. The method of claim 13, wherein selecting the alternate PWM sub-frame control signal includes selecting a second internal control signal or a second external control signal.

19. The method of claim 18, wherein selecting the second internal signal includes configuring the control timing signal as the alternate PWM sub-frame control signal.

20. The method of claim 13, wherein the configuring includes effecting an alternate PWM sub-frame insertion with a period of the clock signal.

21. The method of claim 13, wherein the determining includes extracting at least one phase delay value and at least one of duty cycle value.

22. A liquid crystal display, comprising:

means for configuring a control timing signal by multiplying a clock signal with a multiplier component;

means for establishing a phase signal;

means for configuring one of a sequence of alternate pulse-width modulation (PWM) sub-frame insertions or a sequence of alternate PWM frame insertions based on the phase signal;

means for determining a first set of phase delays and a first set of duty cycles that regulate backlighting in the liquid crystal display for one of an alternate PWM sub-frame insertion in the sequence or an alternate PWM frame insertion in the sequence; and means for regulating backlighting in the liquid crystal display based at least in part on (i) one of the sequence of alternate PWM sub-frame insertions or the sequence of alternate PWM frame insertions and (ii) the first set of phase delays and the first set of duty cycles.

23. The liquid crystal display of claim 22, wherein the mans for establishing the phase signal includes one of (a) means for receiving an external signal and means for configuring the external signal as the phase signal; or (b) means for configuring the control timing signal as the phase signal.

* * * * *